United States Patent [19]

Micheli et al.

[11] 4,349,709

[45] Sep. 14, 1982

[54] RADIO FREQUENCY INTERFERENCE SUPPRESSING IGNITION DISTRIBUTOR

[75] Inventors: Adolph L. Micheli, Mt. Clemens; Wey-Chaung Kuo, Bloomfield Hills, both of Mich.

[73] Assignee: General Motors Corporation, Detroit, Mich.

[21] Appl. No.: 206,021

[22] Filed: Nov. 12, 1980

[51] Int. Cl.[3] ..... H01H 19/00; H01H 1/00

[52] U.S. Cl. ..... 200/19 R; 200/19 DR; 200/267; 200/19 DC; 123/633

[58] Field of Search ..... 200/19 R, 19 DR, 19 DC, 200/264, 265, 266, 267; 338/66, 329; 123/633, 146.5 A

[56] References Cited

U.S. PATENT DOCUMENTS

| | | | |
|---|---|---|---|
| 2,555,488 | 6/1951 | Hetzler et al. | 200/19 |
| 3,361,886 | 1/1968 | Prickett | 200/166 |
| 4,043,030 | 8/1977 | Onishi | 200/19 |
| 4,091,245 | 5/1978 | Komiyama et al. | 200/19 |
| 4,100,385 | 7/1978 | Wutz | 200/267 X |
| 4,146,759 | 3/1979 | Watanabe et al. | 200/19 |
| 4,217,470 | 8/1980 | Kirner | 200/19 R |
| 4,219,707 | 8/1980 | Sawada et al. | 200/19 R |

FOREIGN PATENT DOCUMENTS

| | | | |
|---|---|---|---|
| 54-50735 | 4/1979 | Japan | 123/633 |

*Primary Examiner*—James R. Scott
*Attorney, Agent, or Firm*—Richard G. Stahr

[57] ABSTRACT

An internal combustion engine ignition distributor wherein the circumferentially disposed stationary output electrodes carried by the distributor cap are made up of a resistive material having a predetermined resistance value per unit length.

5 Claims, 5 Drawing Figures

RADIO FREQUENCY INTERFERENCE SUPPRESSING IGNITION DISTRIBUTOR

BACKGROUND OF THE INVENTION

This invention is directed to internal combustion engine ignition distributors and, more specifically, to ignition distributors having an arrangement for suppressing the radiation of the radio frequency interference energy generated across the distributor gap.

As the use of electronic devices is increasing in every aspect of our society, it is becoming increasingly important that spurious radio frequency interference radiation be suppressed to a low level at which any detrimental effect that this interference may have on surrounding electronic devices is minimized or eliminated. One source of undesirable radio frequency interference radiation is the radio frequency interference energy generated across the arc gap, generally referred to as the distributor gap, of an internal combustion engine ignition distributor between the movable rotor output electrode and each of the circumferentially disposed stationary output electrodes carried by the distributor cap. This radio frequency interference energy may be radiated from the ignition system that functions as a radiating antenna. Therefore, an internal combustion engine ignition distributor that effectively suppresses the radio frequency interference energy generated across the distributor gap is desirable.

It is, therefore, an object of this invention to provide an improved broad band radio frequency interference suppressing ignition distributor.

It is another object of this invention to provide an improved broad band radio frequency interference suppressing ignition distributor wherein the effective length of the antenna made up of the ignition system and associated electrical connections is reduced.

It is another object of this invention to provide an improved broad band radio frequency interference suppressing ignition distributor having a resistive load at the radio frequency interference generating source.

It is another object of this invention to provide an improved broad band radio frequency interference suppressing ignition distributor wherein the stationary output electrodes thereof are made up of a resistive material having a predetermined resistance value per unit length.

In accordance with this invention, a radio frequency interference suppressing ignition distributor is provided wherein the stationary output electrodes thereof are made up of a resistive material.

BRIEF DESCRIPTION OF THE DRAWINGS

For a better understanding of the present invention, together with additional objects, advantages and features thereof, reference is made to the following description and accompanying drawing in which.

Figure 2:
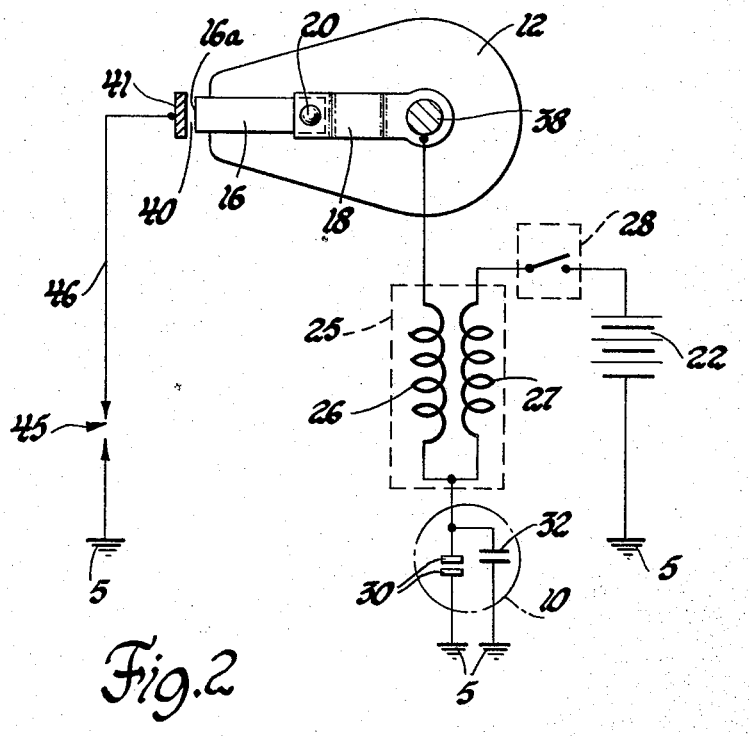
FIG. 2 is a schematic representation of a typical internal combustion engine ignition system.

As point of reference or ground potential is the same point electrically throughout the system, it is represented in FIG. 2 by the accepted schematic symbol and referenced by the numeral 5.

DESCRIPTION OF THE PREFERRED EMBODIMENTS

Figure 1:
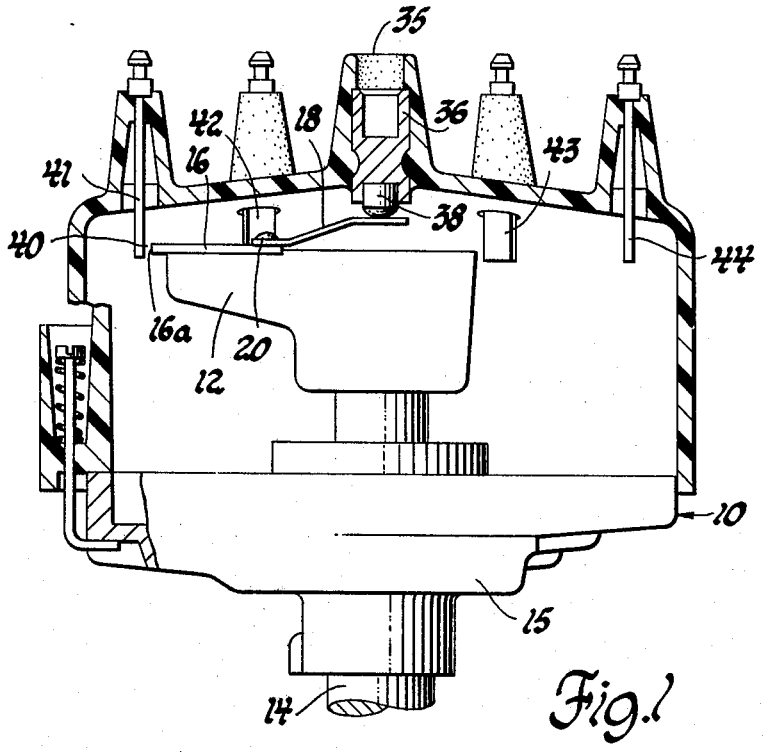
FIG. 1 is an elevation view in partial section of an ignition distributor.

FIG. 1 illustrates a typical internal combustion engine ignition distributor 10 having a rotor member 12 of an insulating material that is arranged to be rotated in timed relationship with an associated engine by a distributor shaft 14 that is journaled for rotation within distributor base 15 as is well known in the automotive art. Carried by rotor member 12 is movable rotor output electrode 16 of an electrically conductive material such as copper or aluminum that extends beyond the edge of rotor member 12 and a spring contact member 18 of an electrically conductive material such as stainless steel, for example, electrically connected to rotor output electrode 16 by a conductive rivet 20. As is best seen in FIG. 2, the primary winding 26 of a conventional ignition distributor 25 is connected across the positive and negative output terminals of a conventional storage battery 22 through the normally open contacts of a single-pole single-throw ignition switch 28 and the ignition distributor breaker contact points 30 and through point of reference or ground potential 5, respectively. Capacitor 32 is the conventional distributor capacitor connected in shunt across breaker contact points 30. As is well known in the automotive art, breaker contact points 30 are operated open and closed in timed relationship with an associated engine by a distributor cam, not shown, that is rotated with distributor shaft 14. Upon each closure of breaker contact points 30, energizing current flows through primary winding 26 and upon each opening of breaker contact points 30, the primary winding 26 and energizing current flow is interrupted. Upon the interruption of the primary winding energizing current flow, the resulting collapsing magnetic field induces an ignition spark potential in secondary winding 27 of ignition coil 25. This ignition spark potential is conducted through lead 34 to the ignition spark potential input terminal 35 of ignition distributor 10, FIG. 1. Ignition spark potential input terminal 35 includes an insert 36 of a conductivè material such as copper or aluminum and a conductive button 38 that may be carbon. Spring contact member 18 is arranged to be in rotary electrical contact with conductive button 38 as is well known in the automotive art. Consequently, spring contact member 18 is electrically connected to the secondary winding 27 of ignition coil 25. As rotor member 12 and, consequently, rotor output electrode 16 are rotated in timed relationship with an associated engine, the output tip **16*a* of rotor output electrode 16 is passed in arc gap relationship with each of the circumferentially disposed stationary output electrodes equal in number to the number of cylinders of the associated engine. In FIG. 1, four stationary output electrodes 41, 42, 43 and 44 are shown with rotor output electrode 16 being aligned with stationary output electrode 41 across distributor gap 40. There is a similar distributor gap between rotor output electrode 16 and each of the other stationary output electrodes. Each of the stationary output electrodes is connected through a suitable spark plug lead to a corresponding spark plug of an associated engine as is well known in the automotive art. In FIG. 2, stationary output terminal 41 is shown to be connected through spark plug lead 46 to a schematically illustrated engine spark plug 45. With the rotor member 12 positioned as shown in FIGS. 1 and 2, upon the opening of breaker contact points 30 subsequent to a previous closure thereof, the resulting ignition spark potential induced in secondary winding 26 of ignition coil 25 is applied across the electrodes of spark plug 45 through lead 34, ignition spark potential input terminal 35, insert 36, button 38, spring contact member 18, rotor output electrode 16, distributor gap 40, stationary output electrode 41 and spark plug lead 46 and through point of reference or ground potential 5. Therefore, during an ignition event, an electrical arc discharges across distributor gap 40 and, of course, across the electrodes of spark plug 45. As there is a distributor gap such as 40 between rotor output electrode 16** and each of the other stationary output electrodes, during the ignition event for each spark plug, there is an electrical spark discharge across the distributor gap corresponding to the spark plug being fired.

The electrical spark discharge across each distributor gap during engine operation generates radio frequency interference energy that is radiated by the stationary output electrode and the corresponding spark plug lead on one side of the distributor gap and by the rotor output electrode 16, the spring contact member 18 and the ignition spark potential lead 34 on the other side of the distributor gap. Each distributor gap, therefore, is a radio frequency interference energy generator and the ignition system electrical connections function as a radiating antenna. The distributor gap and ignition system antenna, consequently, is a source of undesirable radiated radio frequency interference.

To understand the physics of the radio frequency interference radiation generated by the igntion system, an ignition system was studied in terms of antenna theory. In this study, an ignition system was modelled as a linear antenna excited by a constant sinusoidal excitation voltage and the radiated power was mathematically computed with various resistance loadings positioned at various locations relative to the excitation source. The results of this study provide steady state solutions of antenna radiated power as a constant sinusoidal excitation was assumed. Although this is not the case with an ignition system wherein the excitation voltage usually has a spectrum whereby the amplitude varies with frequency, since the study involved a linear system, the solution for the general impulse excitation of an ignition system can be obtained by multiplying the steady state solution of the mathematical study by the particular spectrum of the excitation impulse. The mathematical analysis of the linear antenna reveals that, to have low radiated power over a broad frequency band, the resistive loading must be very close to the excitation source and the resistance per unit length must be large. With these conditions, the effective radiating region is limited to the region proximate the excitation source. In fact, if the resistance per unit length is large and is positioned close to the excitation source, it was determined that the dominant factor in determining the power input to the antenna and, thus, radiated power, is the loading resistance rather than geometric factors. Therefore, it follows that the radiated power from an ignition system is greatly reduced if a large resistive load is located in proximity to the distributor spark gap.

Figure 3:
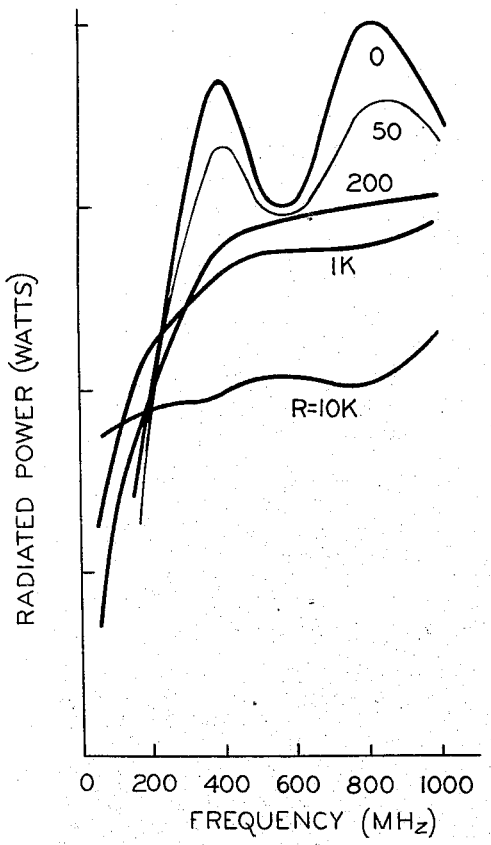
FIG. 3 is a set of curves of calculated radio frequency interference radiated power versus frequency for various values of resistance located at the distributor gap.
Figure 4:
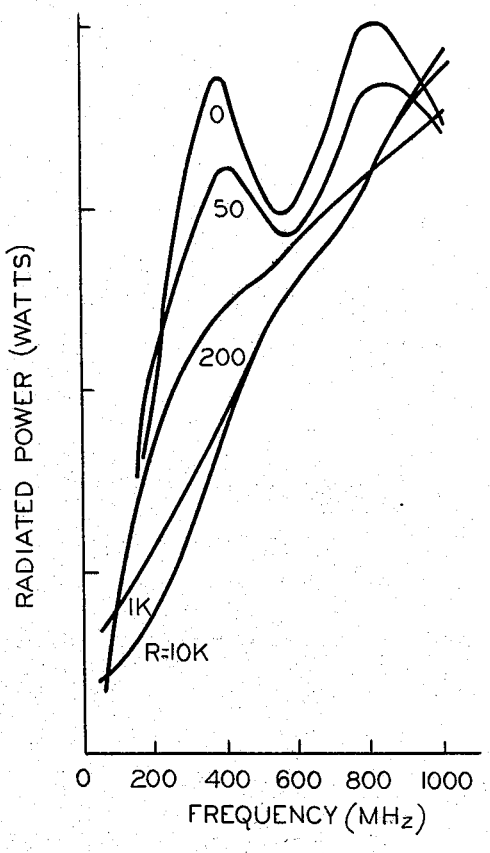
FIG. 4 is a set of curves of calculated radio frequency interference radiated power versus frequency for various ohmic values of resistance located slightly away from the distributor gap.

In summation, this study shows that a resistive loading of an antenna reduces the effective length of the antenna in an electrical sense and that for a given resistance per unit length of the resistive section, the radiated power steadily decreases over a broad frequency band as the resistive section is located near the radio frequency interference generator. In FIG. 3 of the drawing, calculated radio frequency interference radiated power versus frequency is plotted for resistive section values of substantially 0 ohms, 50 ohms, 200 ohms, 1 kilohm and 10 kilohms located at the radio frequency interference generator. The curves of this figure indicate that as the resistance value of the resistive section increases, the calculated power decreases and that with resistive sections of the order of 10 kilohms and higher, the radiated power tends to substantially level off over a broad frequency band of the order of 200 megahertz to 1000 megahertz. In FIG. 4 of the drawing, calculated radio frequency interference radiated power versus frequency is plotted for resistive section values of substantially 0 ohms, 50 ohms, 200 ohms, 1 kilohm and 10 kilohms located 3 cm away from the radio frequency interference generator. The curves of this Figure indicate that the radiated power increases generally with frequency for all values of resistance over the same frequency range as shown in FIG. 3. These curves verify that radiated radio frequency interference energy is reduced over a broad frequency band as the loading resistive section approaches the excitation source.

As the radio frequency interference generator of an ignition distributor is the distributor gap, it follows from the aforementioned study that the resistive section of a selected resistance value per unit length located substantially at the distributor gap significantly reduces the radio frequency radiation generated by ignition distributor gap over a broad frequency band. To locate a resistive section of a selected resistance value per unit length substantially at the distributor gap, each of the distributor stationary output electrodes may be made up of a resistive material having a selected resistance value per unit length. That is, the stationary electrodes such as stationary electrodes 41, 42, 43 and 44 as shown in FIG. 1 may be made of a resistive material having a selected resistance value per unit length to significantly reduce the radio frequency radiation.

Using a standard production distributor rotor electrode coated with a silicon grease as the cathode electrode, an electric spark was generated across a three millimeter gap to each of three different resistivity anode electrodes corresponding to the distributor stationary output electrodes. The radiated radio frequency interference energy was picked up on a conventional conical spiral antenna of the type capable of being calibrated for a frequency range of 200 megahertz to 1000 megahertz located approximately six meters from the spark and displayed on a spectrum analyzer having a resolution of 300 kilohertz. The resulting set of curves of radiated power versus frequency are set forth in FIG. 5.

Figure 5:
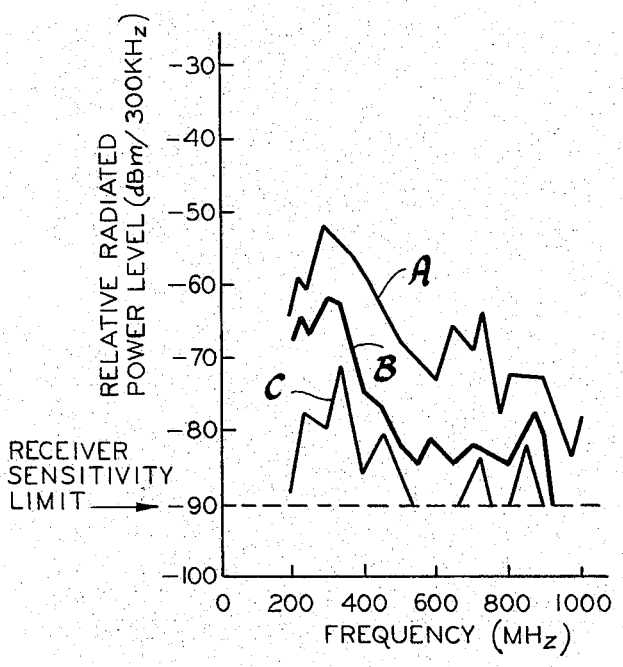
FIG. 5 is a set of curves showing actual radio frequency interference radiated power versus frequency for various values of resistance located at the distributor gap.

In FIG. 5, curve A summarizes the performance of an ignition distributor in which the anode electrodes were formed of metallic aluminum. The electrodes in this and the following tests were all in the form of small rectangular slabs four centimeters long, one centimeter wide and one-tenth of a centimeter thick. Obviously, these aluminum electrodes had a very low electrical resistance and, as curve A shows, the level of radio frequency radiation was relatively high.

Curve B summarizes the performance of an ignition distributor in which the anode electrodes were formed of a highly resistive, synthetic resin bonded composition. Specifically, the composition contained by weight 30.30% brass powder; 45.45% epoxy resin; 7.58% epoxy hardener; 15.15% of a powdered ferrite, nominally $Mn_{0.85}Zn_{0.15}Fe_2O_4$, and 1.52% carbon powder. The electrodes were formed by mixing together a brass putty (80% brass powder, 20% epoxy resin) obtained from Devcon Corporation. Danners, Mass., additional epoxy resin marketed by Armstrong Products Company of Warsaw, Ind. under the designation "A-2," an epoxy hardener and the ferrite and carbon powder. The mixture was poured into a mold and cured at ambient temperature. Electrode slabs of the hereinabove set forth dimensions were cut from the molded material. The electrodes had a lengthwise resistance of the order of 30 kilohms. It is readily apparent from curve B that the radio frequency radiation of the distributor with these electrodes is markedly reduced as compared to curve A.

Curve C summarizes the performance of an ignition distributor in which the anode electrodes were formed of a ceramic material made up of iron oxide ($Fe_2O_3$) doped with 1% by weight titanium dioxide ($TiO_2$). The iron oxide and titanium dioxide powders were mixed together and calcined at 1000° centigrade for one hour to react the materials. The mixture was then ground fine, pressed into the shape of the electrode slabs of the hereinabove set forth dimensions and fired at 1300° centigrade for one hour. The lengthwise resistance of these ceramic electrodes was of the order of 200 kilohms. A study of curves A, B and C of FIG. 5 reveals that both the resistive resin bonded composition electrodes and the ceramic electrodes provide a radiation suppression of the order of 10 decibels or more over a broad frequency band compared with aluminum electrodes. These curves confirm that the radio frequency interference energy radiation generated by the ignition distributor gap is significantly reduced by making the distributor output electrodes of a resistive material having a suitable resistivity. Preferably, the resistivity is of the order of 500 ohm-cm to at least 5000 ohm-cm.

It is to be specifically understood, however, that the same results may be realized by making the movable distributor output electrode carried by the rotor of a similar resistive material having a selected resistivity.

To provide a satisfactory suppression of ignition system generated radio frequency interference energy radiation over a broad frequency band, the resistive material of which the distributor output electrodes are made should have a suitably high resistivity. For example, the material should have a resistivity of 500 ohm-cm to 5000 ohm-cm or greater.

In addition to the epoxy resin bonded brass powder containing electrodes described above, electrodes formed from a like composition based on bronze powder or aluminum powder are suitably resistive for use in the practice of this invention. The carbon powder is considered a necessary ingredient in the electrode to adjust the resistivity to the desired level. The contribution of the ferrite powder is not fully understood but is believed to at least contribute durability to the resin bonded material. It is preferred that resin bonded electrodes of this type be used as the anode electrode because they are less durable when employed as the cathode.

It is recognized that several different ceramic compositions could be formed which would have suitable resistivity for use in the practice of this invention. However, when cost and durability factors are considered, it is preferred that the ceramic composition be based on iron oxide as described above or on titanium dioxide doped with a small amount (up to 1% or 2% by weight) of one or more of the pentoxides of niobium ($Nb_2O_5$), antimony ($Sb_2O_5$) or tantalum ($Ta_2O_5$). Whichever is the base oxide, $Fe_2O_3$ or $TiO_2$, it is doped to form an electrode material having a resistivity of the order of 500 ohm-cm to 5000 ohm-cm or higher. While the ceramic electrodes are more fragile on handling that the resin bonded electrodes, they are more durable in the spark discharge environment of the distributor gap and may be employed as either the cathode or anode electrodes.

Although FIG. 2 of the drawing schematically illustrates an automotive type ignition system having breaker contacts, the underlying principle of this invention is equally applicable to any other type ignition system including ignition systems of the electronic type.

While a preferred embodiment of the present invention has been shown and described, it will be obvious to those skilled in the art that various modifications and substitutions may be made without departing from the spirit of the invention that is to be limited only within the scope of the appended claims.

The embodiments of the invention in which an exclusive property or privilege is claimed are defined as follows:

1. In an ignition distributor of the type wherein a movable electrode electrically connected to the secondary winding of an ignition coil is passed in ignition spark gap relationship with at least one stationary electrode electrically connected to a corresponding spark plug, the improvement wherein either the movable electrode or each stationary electrode is formed of a ceramic material based on an oxide selected from the group consisting of $Fe_2O_3$ and $TiO_2$ and doped to have a resistivity suitable for suppressing the radio frequency interference energy generated by an ignition spark.

2. In an ignition distributor of the type wherein a movable electrode electrically connected to the secondary winding of an ignition coil is passed in ignition spark gap relationship with at least one stationary electrode electrically connected to a corresponding spark plug, the improvement wherein either the movable electrode or each stationary electrode is formed of a ceramic composition selected from the group consisting of (a) $Fe_2O_3$ doped with $TiO_2$ and (b) $TiO_2$ doped with any one or more of $Nb_2O_5$, $Sb_2O_5$ or $Ta_2O_5$, said composition having a resistivity suitable for suppressing radio frequency interference energy generated by an ignition spark.

3. In an ignition distributor of the type wherein a movable electrode electrically connected to the secondary winding of an ignition coil is passed in ignition spark gap relationship with at least one stationary electrode electrically connected to a corresponding spark plug, the improvement wherein either the movable electrode or each stationary electrode is formed of a ceramic $Fe_2O_3$ material doped to have a resistivity suitable for suppressing the radio frequency interference energy generated by an ignition spark.

4. In an ignition distributor of the type wherein a movable electrode electrically connected to the secondary winding of an ignition coil is passed in ignition spark gap relationship with at least one stationary electrode electrically connected to a corresponding spark plug, the improvement wherein either the movable electrode or each stationary electrode is formed of a ceramic $Fe_2O_3$ material doped with $TiO_2$ to have a resistivity suitable for suppressing the radio frequency interference energy generated by an ignition spark.

5. In an ignition distributor of the type wherein a movable electrode electrically connected to the secondary winding of an ignition coil is passed in ignition spark gap relationship with at least one stationary electrode electrically connected to a corresponding spark plug, the improvement wherein either the movable electrode or each stationary electrode is formed of a ceramic $TiO_2$ material doped with any one or more or $Nb_2O_5$, $Sb_2O_5$ or $Ta_2O_5$ to have a resistivity suitable for suppressing the radio frequency interference energy generated by an ignition spark.

* * * * *